US006835019B2

(12) United States Patent
White

(10) Patent No.: US 6,835,019 B2
(45) Date of Patent: Dec. 28, 2004

(54) FLUID APPLICATOR DEVICE

(76) Inventor: Tracy G. White, 61 Lafayette Ave., Seaside Park, NJ (US) 08822

( * ) Notice: Subject to any disclaimer, the term of this patent is extended or adjusted under 35 U.S.C. 154(b) by 3 days.

(21) Appl. No.: 10/800,550

(22) Filed: Mar. 15, 2004

(65) Prior Publication Data

US 2004/0184864 A1 Sep. 23, 2004

Related U.S. Application Data

(63) Continuation-in-part of application No. 10/366,150, filed on Feb. 13, 2003, now abandoned.

(51) Int. Cl.[7] ..... B05C 1/00; A46B 5/02; B43M 11/06; B43K 5/06; B43K 5/00

(52) U.S. Cl. ..... 401/197; 401/6; 401/183; 401/176; 401/179; 401/174; 401/202

(58) Field of Search ..... 401/197, 6, 202, 401/205, 206, 183, 184, 185, 186, 176, 179, 174; 492/16, 17, 28, 30, 37

(56) References Cited

U.S. PATENT DOCUMENTS 199,712 A * 1/1878 Horrocks et al. ..... 193/37
2,860,359 A 11/1958 James
3,154,830 A * 11/1964 Juchniewicz ..... 425/471
3,268,943 A 8/1966 Melnyck
4,648,732 A 3/1987 Smialkowski
4,747,720 A 5/1988 Bellehumeur et al.
4,961,661 A 10/1990 Sutton et al.
5,931,590 A 8/1999 Harris
6,196,743 B1 3/2001 Brucker

* cited by examiner

*Primary Examiner*—David J. Walczak
(74) *Attorney, Agent, or Firm*—Kenneth P. Glynn, Esq.

(57) ABSTRACT

The fluid applicator device includes a handle member, a dispensing member, an applicator member and a fluid dispensing mechanism. The handle member acts as a container member adapted to receive and store a fluid. The handle member has an opening, and has a closure device openable and closeable at the opening for insertion of at least one of: a fluid; and a fluid-containing cartridge. The handle member dispensing end connected to a dispensing member that is elongated and substantially cylindrical. The dispensing member has a plurality of apertures to create a dispensing manifold. The hollow applicator member is located around the dispensing member, and may preferably fully extend over the end of the dispensing member, as well. The hollow applicator member is an absorbent, deformable, resilient, sponge-like material, and it is rotatably connected to the dispensing member.

20 Claims, 6 Drawing Sheets

SECTION A-A

FLUID APPLICATOR DEVICE

REFERENCE TO RELATED CASES

This application is a continuation-in-part of U.S. application Ser. No. 10/366,150, entitled "LOTION APPLICATOR ASSEMBLY", filed on Feb. 13, 2003, now abandoned by the same inventor as herein.

BACKGROUND OF THE INVENTION

1. Field of the Invention

The present invention relates to fluid applicator devices that may be used to apply a liquid, cream, lotion, emulsion or other fluid to a surface. The present invention is particularly useful for applying lotions and body treatments to the body and head. The present invention applicator devices include a handle with fluid storage, as well as a manifold dispensing member and a rolling applicator member. This applicator member has a thick area for large contact applications, and a thinner area at the end for smaller contact areas, i.e., small rolling or end dabbing, such as for the face or other areas smaller than the torso and body. Thus, the present invention devices are useful for suntan applications fluid makeup applications, skin treatment applications, etc.

2. Information Disclosure Statement

The following prior art is representative of the state of the art in the field of applicator devices:

U.S. Pat. No. 6,196,743 describes an apparatus for applying a sun tan lotion to a hard to reach area of a user's skin having an applicator rotatably supported by a shaft extending from an elongated handle traversing a user's palm, the applicator having a compressible layer of closely spaced wick-like absorbent fiber bundles extending generally outwardly from a mat supported on a hollow cylindrical base, the base including a split cylinder grip member contained in a channel along an inner surface for frictional retention of the shaft, the apparatus also including a container for immersion of the applicator in a supply of lotion having an inner surface sufficient in size to create a clearance around an immersed applicator for non-piston travel of the applicator and an opening sized for interference with the compressible layer of the applicator, the apparatus further including an exit reservoir extending from said opening having an outwardly expanding portion for containment and return of liquid separated from said applicator externally of the opening of the container.

U.S. Pat. No. 5,931,590 describes a sun bathing sponge applicator for applying lotion to the human body, which comprises a cylindrical applicator head having an outer face connected to an elongated handle. The applicator head comprises a reservoir within the head for storing lotion and has a plurality of holes placed throughout the outer face of the head for dispensing the lotion stored in the reservoir. A sponge is affixed to the head to absorb the lotion and to facilitate even application of lotion to one's body. The sponge applicator further comprises a sliding assembly for pushing out lotion stored inside the reservoir, thereby permitting the user to selectively dispense the lotion as it is needed.

U.S. Pat. No. 4,961,661 describes the present invention that contemplates a fluid applicator useful for applying a fluid in a uniform and discrete manner to a remote surface wherein said applicator has a fibrous pad which is saturated and retains the fluid until applied to a surface, a valve or throttle means to control the amount of fluid in the fibrous pad and a telescoping handle element which can be extended to provide an elongate handle for reaching remote areas and to expose a cylindrical fluid vessel having a flexible wall which is compressed to extrude fluid therefrom and into the fibrous pad.

U.S. Pat. No. 4,747,720 describes a liquid applicator that includes a combined liquid container and handle with an axially extending, liquid permeable sleeve. An elongated tube having apertures throughout its length provides internal support for the sleeve and valve means provides controlled flow of the liquid from the container, through the tube and to the permeable sleeve. In another embodiment the applicator consists of an elongated arm having an applicator head at one end, the other end having a threaded or snap connection for attachment to a squeeze type container. A plastic tube extends from the head to the container attachment and is enclosed by the arm.

U.S. Pat. No. 4,648,732 describes an applicator for dispensing small amounts of fluid that comprises a first inner cylindrical body provided with a top portion and a bottom portion and at least one side opening. This body is connected with a fluid dispensing device at one end. A second outer cylindrical body is in tight contact with the inner body at one point in proximity of the top portion and at another point in proximity of the bottom portion of the inner body. The outer body comprises a plurality of ribs, orifices between the ribs; two solid ledges holding the ribs at the upper and the lower end, an upper and a lower overhang, and an absorbing element held between the overhangs.

U.S. Pat. No. 3,268,943 describes a paint roller apparatus comprising: a hollow bottle like handle fabricated of pliable material and forming a paint receptacle, said handle having a threaded neck of reduced diameter and a shoulder adjacent thereto; a rigid tube communicating with said handle; a one piece cylindrical cap secured to said tube; said cap having at least two cylindrical portions, one for receiving the threaded neck and the other for receiving a portion of said handle adjacent said neck; said one threaded neck receiving cylindrical portion being secured to said tube and having a U-shaped cross-section; the other handle receiving cylindrical portion in cross-section including a first flange extending radically outwardly from the extremities of the legs of said U-shaped portion and a second flange extending perpendicular from the extremities of said first flange in a direction opposite from said U-shaped neck receiving portion; a cylindrical flange extending from the bight of the said U-shaped neck receiving portion of said cap in the same direction and parallel to the legs thereof, said cylindrical flange being spaced from the legs to tightly receive therebetween the threaded neck of said handle; said legs of said U-shaped portion having threads on their inner surface for receiving the threaded neck of said handle, said second flange tightly receiving said portion of said handle adjacent said threaded neck with said shoulder of said handle abutting against said first flange; said tube including a reverse turn and a portion spaced from and lying generally perpendicular to said handle; said portion of said tube being apertured; an apertured roller rotatably mounted on said portion on said tube; a layer of absorbent material covering said roller.

U.S. Pat. No. 2,860,359 describes a moistening device adapted for use in wetting the adhesive coating of envelope flaps, a flexible handle providing a deformable reservoir therein and having a cap-equipped opening for filling the reservoir with liquid, a stem extending from said handle, said stem being provided with a passage thereon communicating with said reservoir, a mounting member carried by said stem and extending laterally therefrom, said mounting member being equipped with a plurality of restricted flow passageways opening through the surface thereof and communicating with said passage, a sleeve provided with a plurality of openings therethrough rotatably mounted upon said mounting member, and a sponge roller carried by said sleeve, said mounting member being provided with an annular rib extending laterally therefrom, and said sleeve being provided with at least one slit extending longitudinally therealong and with an annular recess aligned with and receiving said rib, said sleeve being removably mounted upon said mounting member, the split portion of said sleeve being operative to facilitate movement thereof onto and off of said mounting member about said annular rib.

Notwithstanding the prior art, the present invention is neither taught nor rendered obvious thereby.

SUMMARY OF THE INVENTION

The present invention relates to a fluid applicator device. It includes a handle member, a dispensing member, an applicator member and a fluid dispensing means.

The handle member acts as a container member adapted to receive and store a fluid. The handle member has an opening, and has a closure device openable and closeable at the opening for insertion of at least one of: a fluid; and a fluid-containing cartridge. The handle member also has a dispensing end connected to a dispensing member.

The dispensing member is elongated and substantially cyclindrical, the dispensing member being connected to the handle member so as to receive fluid therefrom. In some embodiments, the handle may be a single component, while in others, it may be an assemblage of components. The dispensing member may likewise be a single component or an assemblage of components. The dispensing member has a plurality of apertures to create a dispensing manifold.

The hollow applicator member is located around the dispensing member, and may preferably filly extend over the end of the dispensing member, as well. The hollow applicator member is an absorbent, deformable, resilient, sponge-like material, and it is rotatably connected to the dispensing member. The hollow applicator member has a large contact portion with a first outer diameter and has a small contact portion with a second outer diameter, the second outer diameter being at least 20% smaller than the first outer diameter.

The fluid dispensing means is located at the handle and adapted to move fluid from the handle member to the dispensing member to the hollow applicator member via the dispensing manifold.

In some preferred embodiments, the fluid applicator device handle member and the dispensing member may be formed of a single component, while in other embodiments, they may be formed of two or more separate components connected to one another.

In some embodiments, the present invention fluid applicator device fluid dispensing means is a telescopic pumping mechanism wherein the handle member comprises at least two components telescopically connected to one another whereby compression caused by closing the two components pumps fluid from the handle member to the dispensing member and through the manifold to the hollow applicator member.

In other embodiments, the fluid dispensing means is a squeeze pump and the handle member has a flexible structure that may be squeezed for dispensing fluid. In yet other embodiments, the fluid dispensing means is a piston and piston drive. The piston drive may be a rotatable, threaded component connected to the piston or it may be a slider connected to the piston. The piston drive may include a segmented track for metering the piston drive and for controlling the dispensed fluid volume.

In some embodiments, the dispensing member has a single diameter and the hollow applicator member has a single inside diameter adapted to fit the dispensing member, and the hollow applicator member has a first thickness at the large contact position and a second thickness at the small contact position, wherein the first thickness is greater than the second thickness. In other words, it has a single inside diameter and two different outside diameters, the smaller being toward and at the end.

In other embodiments, the dispensing member has a first outer diameter position and a second outer diameter position, and the first outer diameter position is greater than the second outer diameter position, and the hollow applicator fits over both the first outer diameter position and the second outer diameter position.

The fluid applicator device, in some embodiments, further includes rotation means connected to the dispensing member and the hollow applicator member, and is rotatable relative to at least one of the dispensing member and the hollow applicator member. The rotation means may be any rotation means, such as a rotatable sleeve, a plurality of bearings, or at least one ring. This ring may be a flexible seal O-ring. In some preferred embodiments, the fluid applicator device has at least two the flexible seal O-rings.

The fluid applicator device of the present invention may further include an applicator member cover adapted to fit over the hollow applicator member. This cover may include an attachment means for securing the cover to the handle member when it is removed from the hollow applicator member.

BRIEF DESCRIPTION OF THE DRAWINGS

These and other objects of the present invention will become evident particularly when taken in light of the following illustrations wherein.

DETAILED DESCRIPTION OF THE INVENTION

Individuals have need to apply various types of lotions to various parts of the body. In the summer time, suntan lotion or sun blocking lotion is normally applied to all portions of the exposed skin. At all times of the year, many individuals apply moisturizing lotions or gel to various parts of the body. In some instances, individuals are required to apply medicinal ointments to specific areas of the body.

These lotions are normally packaged and purchased in plastic, squeezable, or pour containers, with the individual user dispensing the lotion onto their hands or onto a cloth and rubbing it on the desired body part. In many instances, the individual requires assistance in applying the lotion to specific body parts, i.e. the back, because the individual's hands and arms cannot reach particular areas of that location. Still further, some individuals suffer from disabilities such that they could not reach areas of the body that could be reached by an individual having no such disability.

Another drawback of lotions which are dispensed from squeezable containers or poured is that they require the use of the hands for application or in some instances a cloth for application, which requires the washing or wiping of the hands, or the disposal of the cloth. This is particularly annoying in some situations, such as when one is sunbathing at the beach, and the hands become sticky as a result of the application of the lotion.

Applicant has addressed this problem in developing an assembly which provides for a container member which is squeezable and also serves as a handle member for an applicator member which allows application of the particular lotion directly to the desired body part without contact to the hands, the container member being slideably extendable to allow the individual to reach all parts of the body, the container member being refillable from standard, purchased lotion containers, there further being a protective sleeve member slideably receivable over the applicator member to protect it when not in use.

Figure 3:
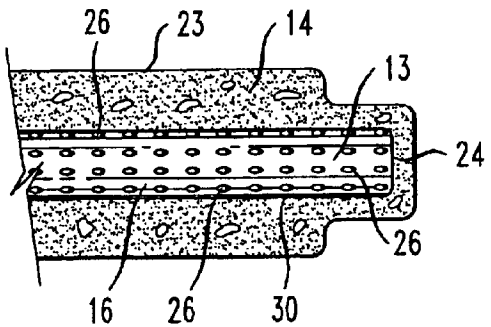
FIG. 3 is a cross sectional view along plane A-A of FIG. 1, illustrating the cooperation between the applicator member and the dispensing member of the present invention device illustrated above.
Figure 1:
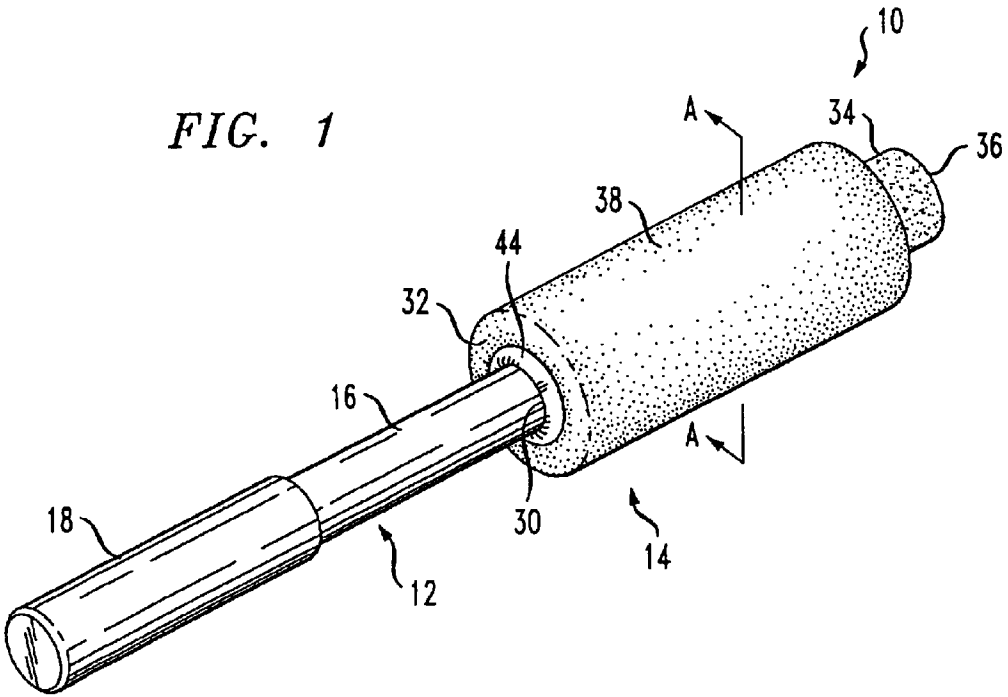
FIG. 1 is a perspective view of one embodiment of the present invention applicator assembly device.

FIG. 1 is a perspective view of a first embodiment of the applicator assembly 10 with FIG. 3 being a cross sectional view of applicator assembly 10 along plane A-A of FIG. 1. FIGS. 1 and 3 are taken collectively in the following discussion.

Applicator assembly 10 comprises a handle member 12, a dispensing member 13, and an applicator member 14. Handle member 10 is preferably of tubular construction, having a first tubular member 16 that has an apertured portion that establishes the dispenser member 13 on which applicator member 14 is rotatably mounted. A second tubular member 18 is telescopically attached to first tubular member 16 so that the applicator assembly can be extended to permit the user to reach all parts of the body and/or to create a pumping dispensing mechanism. Tubular member 16 has a first terminus 20 having a removable securable cap 22 (See FIG. 4) to permit the user to introduce a lotion into first tubular member 16. First tubular member 16 may be deformable to permit the user to squeeze its circumferential side wall and thus aid in the flow of the lotion contained therein towards second terminus 24 of dispenser member 13. The dispenser member 13 proximate second terminus 24 has a plurality of apertures 26 about its circumferential side wall. This permits the passage of lotion through apertures 26 and into applicator member 14.

Applicator member 14 is fabricated from a sponge-like, absorbent material. It may be made of any foam, sponge or porous rubber material, e.g. a hollow urethane foam member. Applicator member 14 is cylindrical in shape having a partial bore 30 formed in first end 32 for slidable receipt upon first dispenser member 13. Second end 34 of applicator member 14 is tapered so as to form a nipple protrusion 36. Nipple protrusion has an outer diameter that is less than the outer diameter of the remaining portion 23. Thus portion 23 may be used for large contact areas and nipple portion 36 may be used for small contact areas. For example, nipple 36 may be utilized by an individual in applying lotion in a dab-like manner to specific portions of the body, such as sun tan lotion applied around the eyes or to the nose. The outer circumferential surface 38 of applicator member 14 may be utilized to apply lotion of large surfaces of the body. There is fitted about partial bore 30 in first end 32, an annular stop member 44 which prevents lotion from seeping down first tubular member 16, annular stop member 44 may also have a circumference substantially identical to circumferential surface 38 so that the protective sleeve cover 40 (FIG. 2) may. comparably snap fit with it to prevent contamination of applicator member 14 when not in use.

FIG. 3 a cross sectional view along plane A-A of FIG. 1 illustrating the plurality of apertures 26 and circumferential side wall of first tubular member 16 and the manner in which first tubular member 16 extended portion forming dispensing member 13 is inserted into partial bore 30 a distance sufficient for applicator member 14 to contain all that portion of dispensing member 13 having the plurality of apertures 26.

Figure 2:
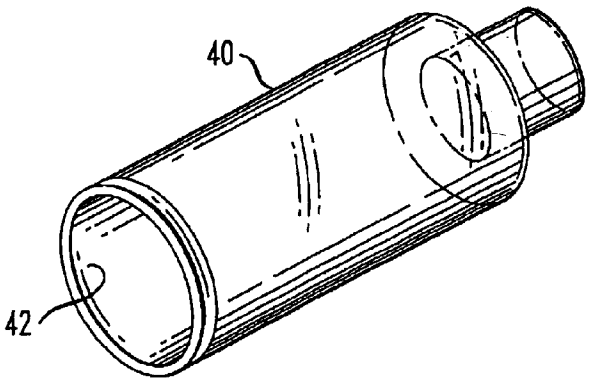
FIG. 2 is a perspective view of the protective sleeve member for the applicator assembly device.

FIG. 2 illustrates protective sleeve cover 40, which is used to protect the applicator member 14 from contamination by sand, dirt, soot and the like and to protect other items from accidental staining, etc. Protective sleeve cover 40 is of one piece construction, preferably of plastic, and formed to define a cavity 42 which conforms to the outer contour of the applicator member 14. In preferred embodiments, it is airtight.

Figure 4:
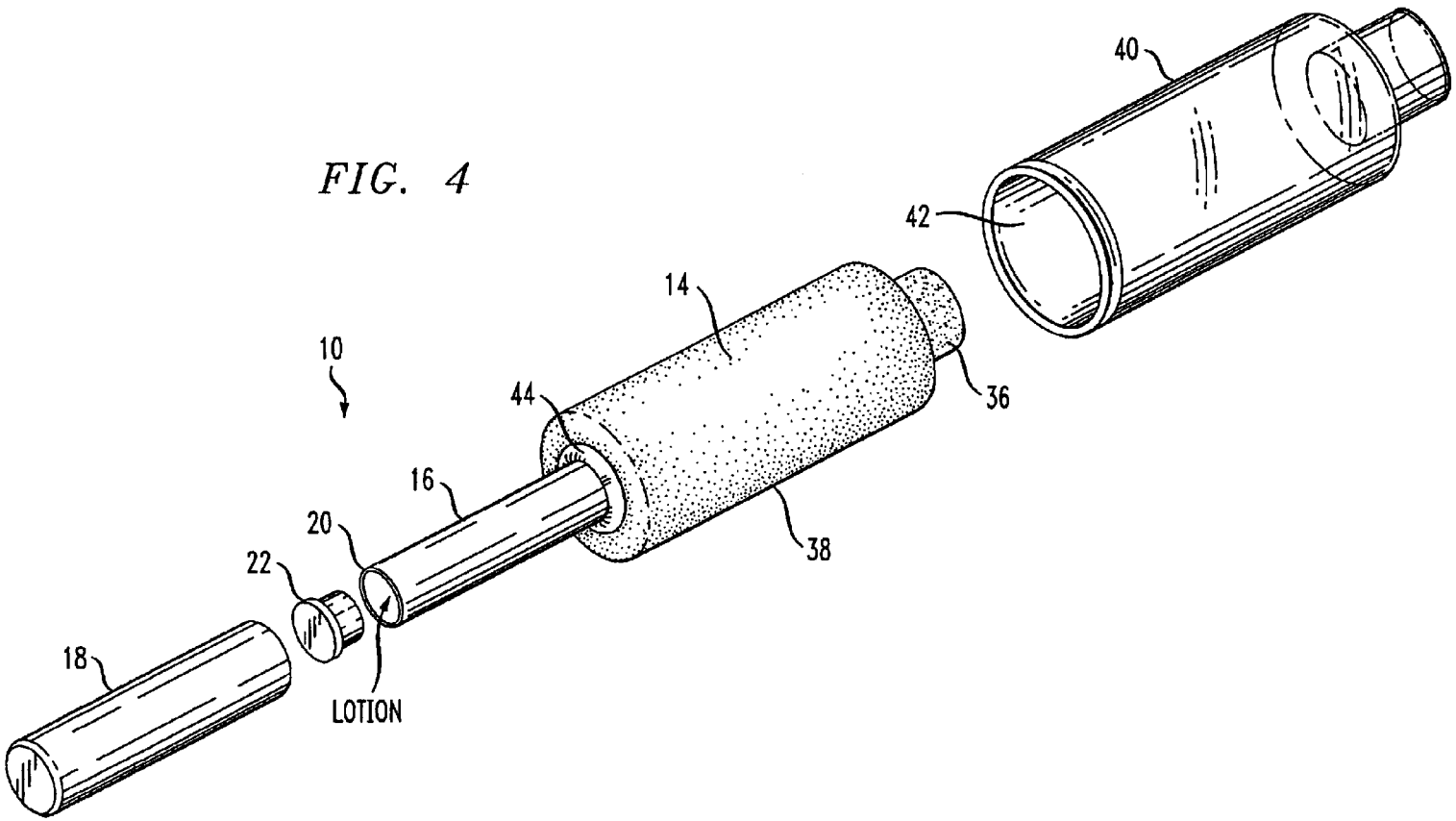
FIG. 4 is an exploded view of the assembly.

Referring to FIG. 4, in one embodiment, second tubular member 18 would be telescopingly positioned about first tubular member 16, and in its closed position, presenting the shortest handle available on applicator assembly 10. In its open, extended position, it would provide more reaching distance. Pull to remove, and this allows the user access to cap 22, which is removably secured to first tubular member 16. The user would remove cap 22 and fill first tubular member 16 with the preferred fluid, e.g. lotion. Cap member 22 would then be resecured to first tubular member 16 and second tubular member 18 could be snapped back on and closed, and subsequently extended to its desired length.

The user could then remove the protective sleeve cover 40 from applicator member 14 and contact that portion of the applicator member desired with the desired area of skin surface. The user would move the outer surface 38 of applicator member 14 over the desired portion of skin surface, while simultaneously squeezing the first tubular member 16 to encourage the passage of the lotion through the plurality of apertures 26 forming a manifold, into the applicator member 14, thus saturating same. After the first use such as this, a portion of the lotion will be retained in the applicator member 14 and will be protected from drying out and foam contamination by use of the protective sleeve cover 40. Therefore, the user will find that in subsequent applications, it might not be necessary to squeeze the tube simultaneously while contacting the desired skin surface.

In a preferred embodiment of applicator assembly 10, applicator member 14 can be mounted onto the dispensing member 13 in the manner which allows for applicator member 14 to rotate freely and thus allow the user to roll the applicator member across the desired skin surface area. The rotation of applicator member 14 on dispensing member 13 could be accomplished in a number of different ways. One economical way would be to first mount applicator member 14 on an apertured sleeve positioned within partial bore 30 with this apertured sleeve slideably rotatably securable on dispensing member 13 and rotatable thereabout thus imparting the rotational ability to applicator member 14.

Figure 5:
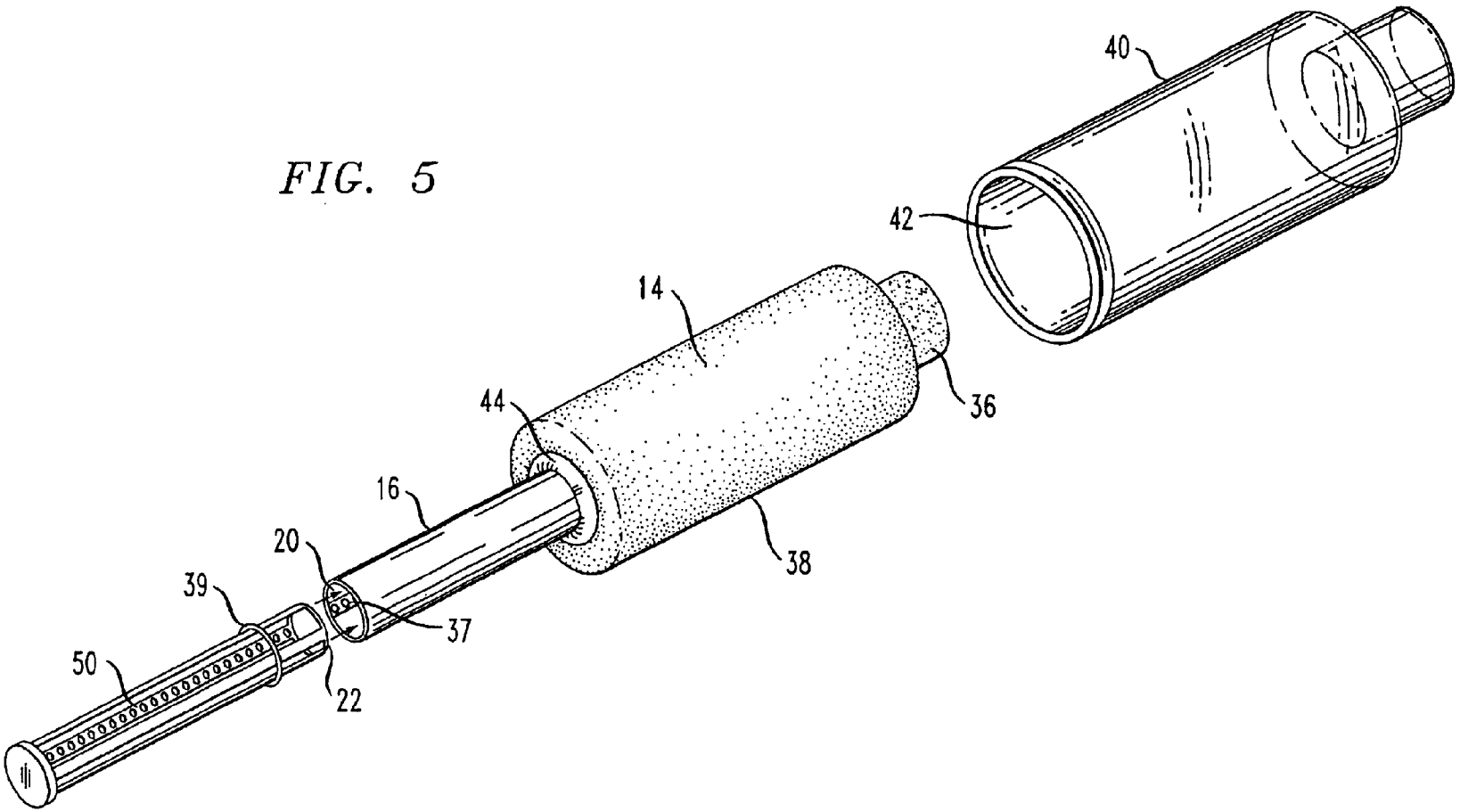
FIG. 5 is an exploded view of a second embodiment of the handle member.

A further embodiment of the present invention without departing from its spirit and scope would be to modify the telescopic handle member so as to still include a first tubular member 16 and have an extended, secured tubular handle function as a pump. Therefore, second tubular member 50 as illustrated in FIG. 5 which would snap into and telescope with first tubular member 16 and be capable of being locked in place in the telescopic extended position. When pushed inward it would pump fluid into and through the apertures to applicator member 14. Second tubular member 50 could have longitudinal slots cooperative with raised longitudinal protrusions inside first tubular member 16 to allow for slot-guided pumping. Stops could make it difficult for separation of these two sections to minimize accidental spillage.

It will be recognized by those skilled in the art that the dimensions of the applicator assembly 10 can be varied without departing from the spirit and scope of the invention. Applicant believes that the optimum dimensions would be an applicator member 14 being approximately 6 inches in length with the main body being approximately 4 inches in length, and the nipple end 36 being approximately 2 inches in length. The first tubular member 16 and its continuation as dispensing member 13 would extend outwardly from the applicator member a distance of approximately 5½ inches, with first tubular member 16 being 5 inches in circumference to provide for an adequate reservoir of fluid, e.g. lotion. The second tubular member 18 may extend the handle member 10 an additional 4 to 4½ inches and thus provide an applicator assembly when fully extended of a length of between 15 and 16 inches, which length has been determined to enable the user to comfortably position the applicator member on any portion of the skin surface of the body that the user so desires.

Figure 6:
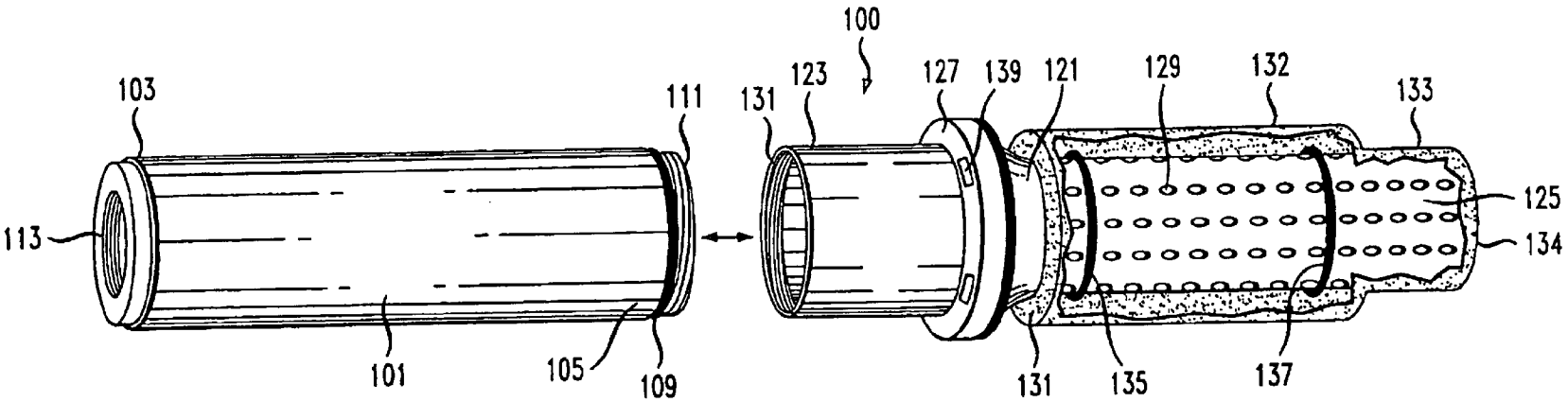
FIG. 6 is a perspective view of an alternative embodiment applicator assembly.
Figure 7:
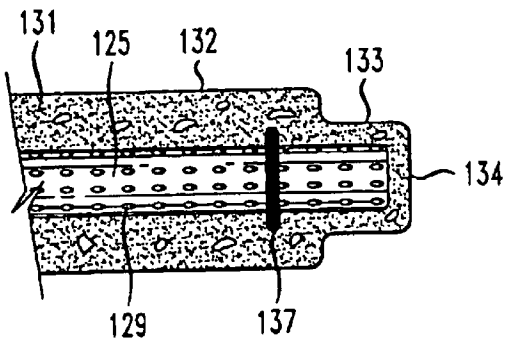
FIG. 7 is a side, partial, cut view of the applicator member end of the present invention device shown in FIG. 6.

FIG. 6 is a perspective view of an alternative embodiment present invention fluid applicator assembly device 100. FIG. 7 is a side, partial, cut view of the applicator member 131 of the present invention device 100 shown in FIG. 6. These two Figures are taken together. Present invention fluid dispensing device 100 includes a handle member 101, with closed top end 103 and open bottom end 105. Top end 103 has optional cover engagement threading 113, and bottom end 105 has a seal 109, and threading 111, for screwing engagement with internal threading 131 of the top 123 of dispensing member 121.

Dispensing member 121, in this embodiment, is a separate component, but it could be a continuation of the handle member 101 structure in other embodiments. Dispensing member121 also has a bottom end 125, and a plurality of dispensing orifices, such as orifice 129, that create a dispensing manifold. Rotating rings 135 and 137 enable applicator member 131 to rotate about dispensing member 121. Dispensing member 131 includes a thick portion 132 for large contact areas, and a thinner portion 133 for small contact areas, as well as for dabbing with end 134. Flange 127 includes a catch such as recess 139 for removably attaching cover 140 (FIG. 8).

When the device is filled with cream or lotion, for example, the components are screwed together and the cover is removed. The user will squeeze the flexible handle member 101 and fluid will exit the manifold to the applicator member. By mere gentle rolling and pressing, the fluid in the applicator will be transferred to the desired surface, e.g. skin.

Figure 8:
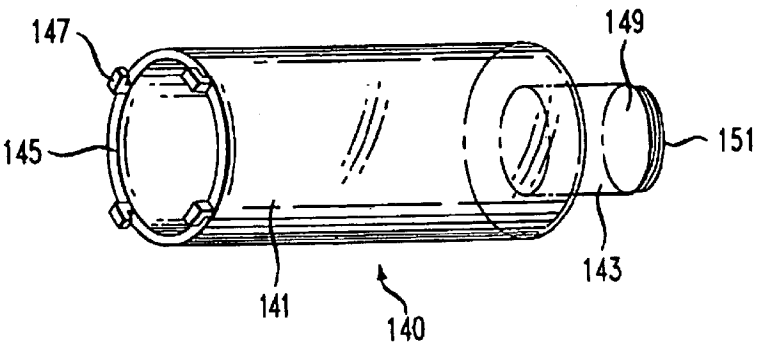
FIG. 8 shows a perspective view of a protective cover of the FIG. 6 present invention device.

FIG. 8 shows a perspective view of the protective cover 140 for the FIG. 6 present invention device 100 in a perspective view. It includes clasps such as clasps 145 and 147, larger cylindrical sidewall 141 to cover the portion 132 of the applicator member 131, and smaller cylindrical sidewall 143 to cover the portion 134 of the applicator member 131. It has a closed end 149 to protect end 134 and has threading 151 for engagement with threading 113. When so threaded, the cover is kept together with the rest of the device, and also acts as a length extender for the device so that the user may reach otherwise difficult areas to reach during application of suntan or the like.

Figure 9:
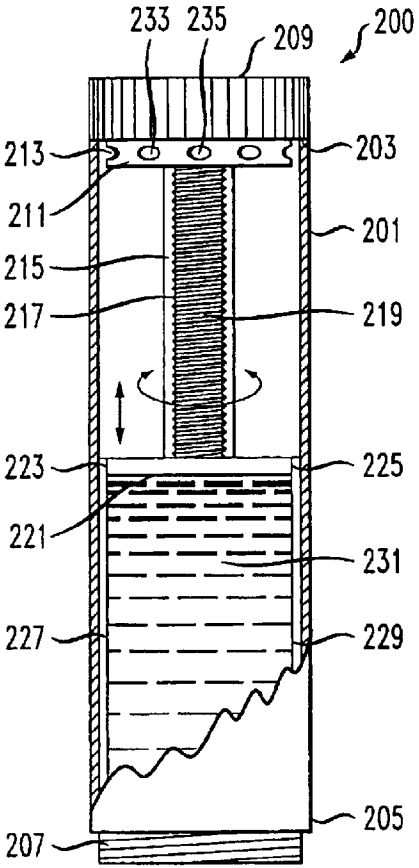
FIG. 9 illustrates a front cut view of a handle member of an alternative embodiment present invention device.

FIG. 9 illustrates a front cut view of a handle member of an alternative embodiment present invention device 200. It shows handle 201 with top end 203 and bottom end 205. Bottom end 205 has threading 207 for attachment to a dispensing member. There may be a valving arrangement, such as a flap valve that needs pressure to open, so that the handle 201 may be inverted and filled, a dispensing member may be filled, such as one shown in FIG. 6, and they may be screwed together without spillage.

In FIG. 9, rotating dial 209 is connected to disc 211 and screw shaft 219. Disc 211 has beads or indicator resistance recesses, such as recesses 233 and 235, that can be used to feel metered dispensing upon rotation (the user can stop at each resistance or continue to rotate). These engage with corresponding bumps such as bump 213 that are fixed inside handle 201. When the handle is filled with fluid 231 and connected as in FIG. 6, a user will rotate dial 209 and this will screw down drive piston 221 via its screw pipe 215 and threads 217. Drive piston 221 slides downward and cannot rotate due to its slots 223 and 225 engaging guide tracks 227 and 229, and forces fluid 231 to a dispensing member through its orifices to an applicator member for application thereof.

Figure 10:
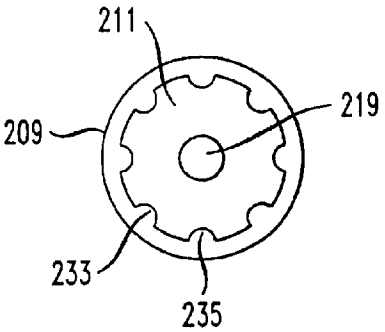
FIG. 10 is a bottom view of the rotating piston drive of the present invention device shown in FIG. 9.

FIG. 10 is a bottom view of the rotating piston drive dial 209 and its connected components, of the present invention device 200, as shown in FIG. 9, with identical parts identically numbered.

Figure 11:
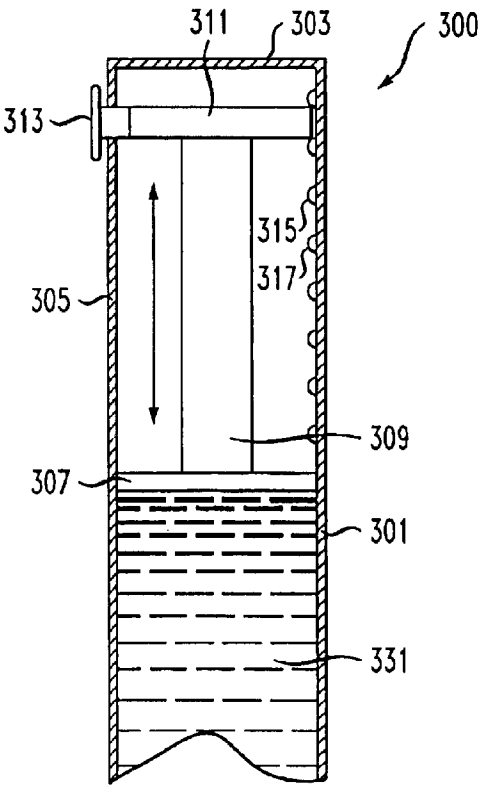
FIG. 11 shows a slider-type piston drive mechanism as a dispensing means, in a partially cut, front view of a present invention alternative embodiment handle member.

FIG. 11 shows a slider-type piston drive mechanism as a dispensing means, in a partially cut, front view of a present invention alternative embodiment handle member 300. It includes a handle 301, with a closed top 303 and an open bottom connectable to a dispensing member and has an open slot 305 for slider button 313, as shown. Slider button 313 is connected to cross disc 311 and it is connected to slider shaft 309, itself connected to drive piston 307. Disc 311 must overcome stops such as stops 315 and 317 in order to be slid downward. This enables a user to push the slider button 313 downwardly in fixed increments for metered dispensing of fluid 331. It is otherwise connected to additional components as is described above with respect to FIG. 9.

Figure 12:
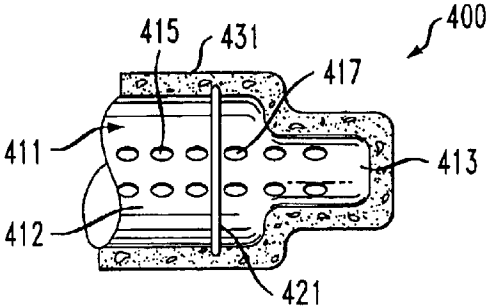
FIG. 12 is a side, cut, partial view of another present invention device dispensing member and applicator member; and, FIG. 13 is a side, cut, partial view of another present invention device dispensing member and applicator member wherein there is a sleeve type rotating mechanism between the another present invention device dispensing member and applicator member.

FIG. 12 is a side, cut, partial view of another present invention device 400, showing the dispensing member 411 and applicator member 431. It includes two different outer diameters on the dispensing member 411, one being larger portion 412, and the other being smaller portion 413. Dispensing member 411 has a plurality of orifices located on both of its portions, such as orifices 415 and 417. Slip ring 421 aids in freer rotation of applicator member 431 around dispensing member 411.

Figure 13:
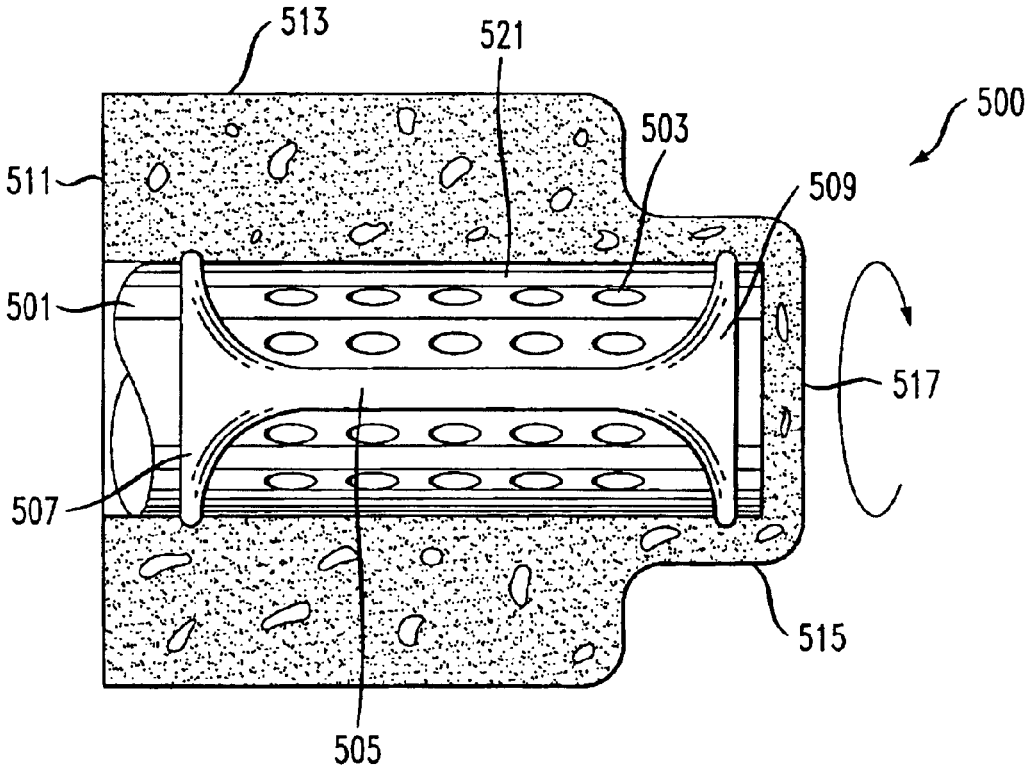

FIG. 13 shows present invention device 500 in a partial, side, cut view of its dispensing member 521 with its apertures such as aperture 503, roller sleeve 505 and applicator member 511. Sleeve 505 includes bands 507 and 509 that traverse the dispensing member 521 and are connected to one another as shown. Applicator member 511 has a large outer diameter section 513, a smaller diameter section 515, and a dabbing end 517. The sleeve 505 moves around the dispensing member 521 and applicator member 511 travels with it.

Obviously, numerous modifications and variations of the present invention are possible in light of the above teachings. It is therefore understood that within the scope of the appended claims, the invention may be practiced otherwise than as specifically described herein.

What is claimed is:

1. A fluid applicator device, which comprises:

(a.) a handle member, said handle member being a container member adapted to receive and store a fluid, said handle member having an opening, and having a closure device openable and closeable at said opening for insertion of at least one of a fluid, and a fluid-containing cartridge, said handle member having a dispensing end connected to a dispensing member;

(b.) said dispensing member being elongated and substantially cyclindrical, said dispensing member being connected to said handle member so as to receive fluid therefrom, said dispensing member having a plurality of apertures to create a dispensing manifold;

(c.) a hollow applicator member located about said dispensing member, said hollow applicator member being an absorbent, deformable, resilient, sponge-like material, said hollow applicator member being rotatably connected to said dispensing member, said hollow applicator member having a large contact portion with a first outer diameter and having a small contact portion with a second outer diameter, said second outer diameter being at least 20% smaller than said first outer diameter; and (d.) a fluid dispensing means located at said handle and adapted to move fluid from said handle member to said dispensing member to said hollow applicator member via said dispensing manifold.

2. The fluid applicator device of claim 1 wherein said handle member and said dispensing member are formed of a single component.

3. The fluid applicator device of claim 1 wherein said handle member and said dispensing member are formed of two separate components connected to one another.

4. The fluid applicator device of claim 1 wherein said fluid dispensing means is a telescopic pumping mechanism wherein said handle member comprises at least two components telescopically connected to one another whereby compression caused by closing said components pumps fluid from said handle member to said dispensing member and through said manifold to said hollow applicator member.

5. The fluid applicator device of claim 1 wherein said fluid dispensing means is a squeeze pump and said handle member has a flexible structure that may be squeezed for dispensing fluid.

6. The fluid applicator device of claim 1 wherein said fluid dispensing means is a piston and piston drive.

7. The fluid applicator device of claim 6 wherein said piston drive is a rotatable, threaded component connected to said piston.

8. The fluid applicator device of claim 6 wherein said piston drive is a slider connected to said piston.

9. The fluid applicator device of claim 8 wherein said piston drive includes a segmented track for metering said piston drive for controlling dispensed fluid volume.

10. The fluid applicator device of claim 7 wherein said piston drive includes a segmented track for metering said piston drive for controlling dispensed fluid volume.

11. The fluid applicator device of claim 1 wherein said dispensing member has a single diameter and said hollow applicator member has a single inside diameter adapted to fit said dispensing member, and said hollow applicator member has a first thickness at said large contact position and a second thickness at said small contact position, wherein said first thickness is greater than said second thickness.

12. The fluid applicator device of claim 1 wherein said dispensing member has a first outer diameter position and a second outer diameter position, and said first outer diameter position is greater than said second outer diameter position, and said hollow applicator fits over both said first outer diameter position and said second outer diameter position.

13. The fluid applicator device of claim 1 wherein said device further includes rotation means connected to said dispensing member and said hollow applicator member, and is rotatable relative to at least one of said dispensing member and said hollow applicator member.

14. The fluid applicator device of claim 13 wherein said rotation means is a rotatable sleeve.

15. The fluid applicator device of claim 13 wherein said rotation means is a plurality of bearings.

16. The fluid applicator device of claim 13 wherein said rotation means is at least one ring.

17. The fluid applicator device of claim 16 wherein said at least one ring is a flexible seal O-ring.

18. The fluid applicator device of claim 17 wherein there are at least two said flexible seal O-rings.

19. The fluid applicator device of claim 1 wherein said device further includes an applicator member cover adapted to fit over said hollow applicator member.

20. The fluid applicator device of claim 19 wherein said cover includes attachment means for securing said cover to said handle member when it is removed from said hollow applicator member.

* * * * *